US005615498A

United States Patent [19]

Challande et al.

[11] Patent Number: 5,615,498

[45] Date of Patent: Apr. 1, 1997

[54] SPORT BOOT, PARTICULARLY ALPINE SKI BOOT

[75] Inventors: Christian Challande, Cruseilles; Pierre Desarmaux, Evires; Pascal Thomas, Chambery, all of France

[73] Assignee: Salomon S.A., Metz-Tessy, France

[21] Appl. No.: 501,861

[22] Filed: Jul. 13, 1995

[30] Foreign Application Priority Data

Jul. 13, 1994 [FR] France ..... 94 08941

[51] Int. Cl.[6] ..... A43B 5/04

[52] U.S. Cl. ..... 36/117.3; 36/117.1

[58] Field of Search ..... 36/117.1, 117.3, 36/118.2

[56] References Cited

U.S. PATENT DOCUMENTS

| | | | |
|---|---|---|---|
| 3,709,509 | 1/1973 | Hildebrand | 280/11.35 T |
| 4,543,738 | 10/1985 | Mower | 36/117 |
| 4,697,360 | 10/1987 | Sartor | 36/117 |
| 5,293,702 | 3/1994 | Miyoshi et al. | 36/117 |

FOREIGN PATENT DOCUMENTS

| | | | |
|---|---|---|---|
| 130779 | 12/1932 | Austria | 36/117 |
| 250829 | 11/1966 | Austria | 36/117 |
| 804900 | 3/1951 | Germany | 36/117 |
| 1807074 | 5/1970 | Germany | A63C 9/08 |
| 1916754 | 10/1970 | Germany | 36/117 |
| 2449514 | 4/1976 | Germany | A43B 5/04 |
| 2802251 | 7/1979 | Germany | A63C 9/085 |
| 323595 | 8/1957 | Switzerland | 36/117 |
| 549969 | 6/1974 | Switzerland | 36/117 |
| 679362 | 2/1992 | Switzerland | 36/117 |

*Primary Examiner*—Ted Kavanaugh
*Attorney, Agent, or Firm*—Greenblum & Bernstein P.L.C.

[57] ABSTRACT

The invention relates to a ski boot adapted to be maintained in support on a ski in a manner whereby it can be freed by front and rear binding elements affixed to the ski. The boot includes a front tip, and a rear tip, the zones of retention and support extending on both sides of a vertical median plane. The front tip has a retention feature with asymmetrical mechanical characteristics with respect to the median plane so as to allow for the release of the boot as a result of a torsional bias beyond a bias threshold which is different depending upon the direction of rotation in which the torsional bias is exerted.

21 Claims, 2 Drawing Sheets

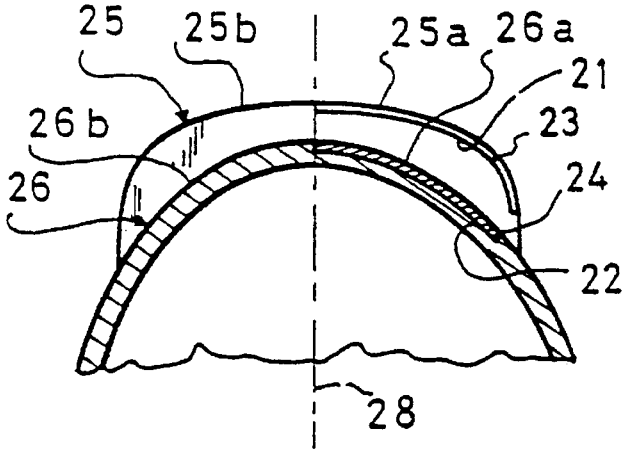
Fig. 4
Fig. 5
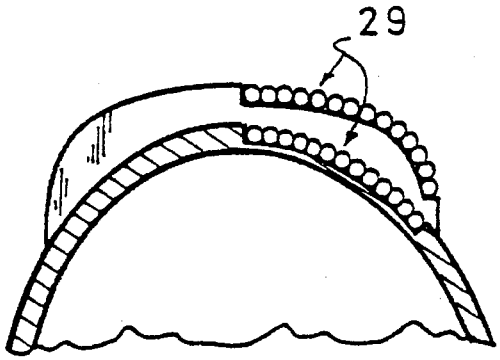
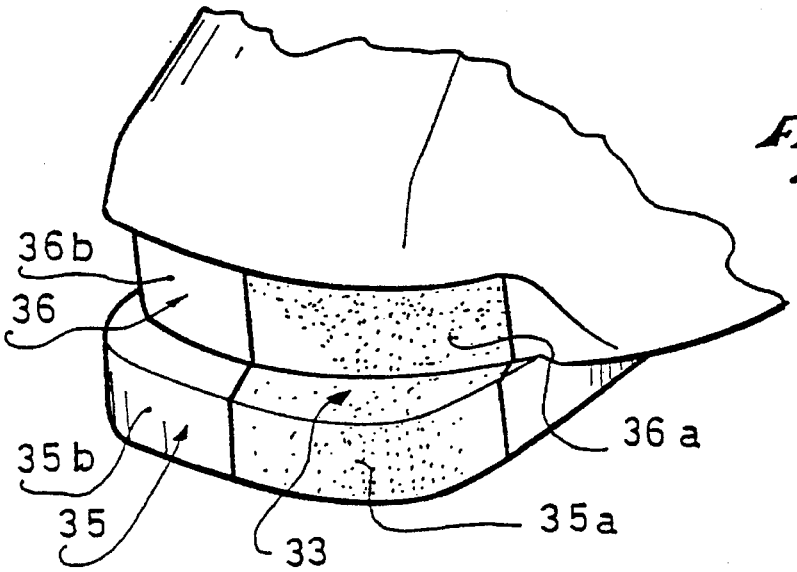
Fig. 6

SPORT BOOT, PARTICULARLY ALPINE SKI BOOT

BACKGROUND OF THE INVENTION

1. Field of the Invention

The present invention is related to a shoe, and particularly an alpine ski boot, adapted to be retained during support on a gliding surface, in a manner such that it can be freed. It likewise relates to a pair of boots.

2. Description of Background and Material Information

An alpine ski boot is generally retained in support against a ski by front and rear binding elements. Each binding element has a retention jaw which is movable against the return force of a spring, so as to free the boot beyond a predetermined bias threshold.

In the past, a shoe was provided to function with binding elements of a particular type. For example, U.S. Pat. No. 3,709,509 shows a boot whose tips have a projection which cooperates with a corresponding recess in the jaw of the binding element. Such boots could only be utilized with specific binding elements.

More recently, a standard defining the shape of the front and rear tips of the boot has been adopted. In the ISO Standard, this standard is identified under No. ISO 5355.

According to this standard, the tips of the boot which include the end of the sole and the lower portion of the upper have a symmetrical form with respect to a vertical and longitudinal plane.

This form thus defined can be associated with different models of binding elements. Furthermore, it can equally be used with one or the other of the two skis of a pair.

Thus, in the course of skiing, for a torsional bias of the boot corresponding to a lateral release of the front tip out of the front binding, the bias threshold beyond which the binding element frees the boot is the same as the torsional force, tends to make the boot go out towards the interior of the foot or towards the exterior.

Now, it is known that the knee of a human being is more or less resistant to a torsional bias exerted on the leg, along the direction thereof. In particular, the knee is more fragile for a rotation of the foot towards the interior, i.e., towards the other foot.

SUMMARY OF THE INVENTION

The objective of the invention is to propose a boot which improves the protection of the knee.

Another aim of the invention is to propose a boot which remains compatible with the binding elements of the market, as well as a standardized ski boot.

Another aim of the invention is to propose a ski boot which is simple to manufacture.

Thus, by providing the tip of the boot with means for retaining the ski boot upon the ski, the retention means having asymmetrical mechanical characteristics, the boot is made more easily freeable towards one side than the other. In other words, the ski boot escapes the binding element more easily in one direction of bias than in the other. This first direction advantageously corresponds to the direction where the knee of the skier is most fragile.

According to a first embodiment of the invention, one adapts the shape of the front tip of the boot to render the boot more easily freeable on one side.

According to another embodiment of the invention, one diminishes the friction between a portion of the tip and the binding element.

BRIEF DESCRIPTION OF THE DRAWINGS

The invention will be better understood with reference to the description below and to the annexed drawings which form an integral part of the invention, in which:

FIG. 4 illustrates in the same way a second embodiment of the invention.

FIG. 5 illustrates an alternative embodiment.

FIG. 6 illustrates yet another alternative embodiment.

DETAILED DESCRIPTION

Figure 1:
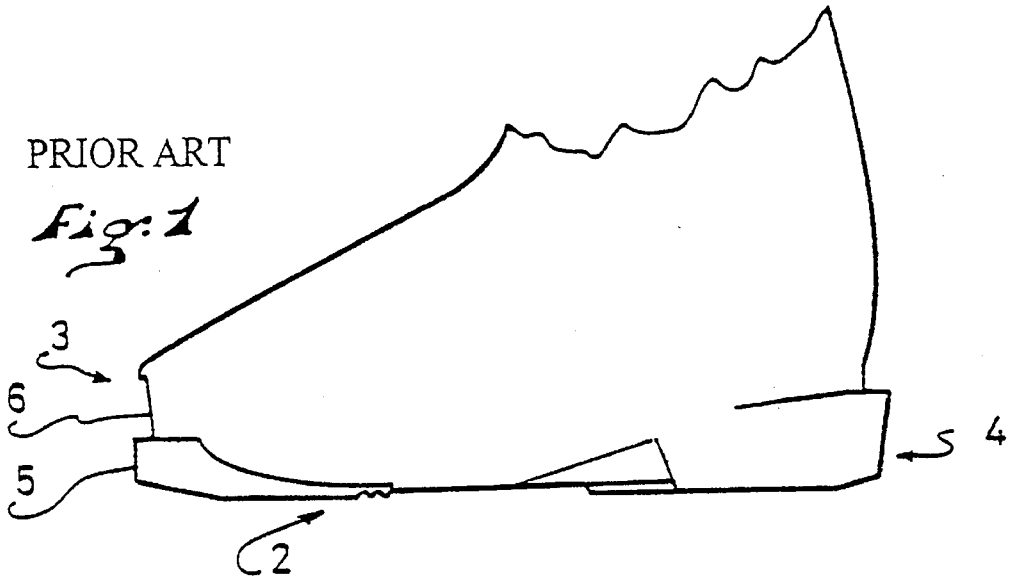
PRIOR ART Fig: 1
FIGS. 1 and 2 illustrate the state of the art.
Figure 2:
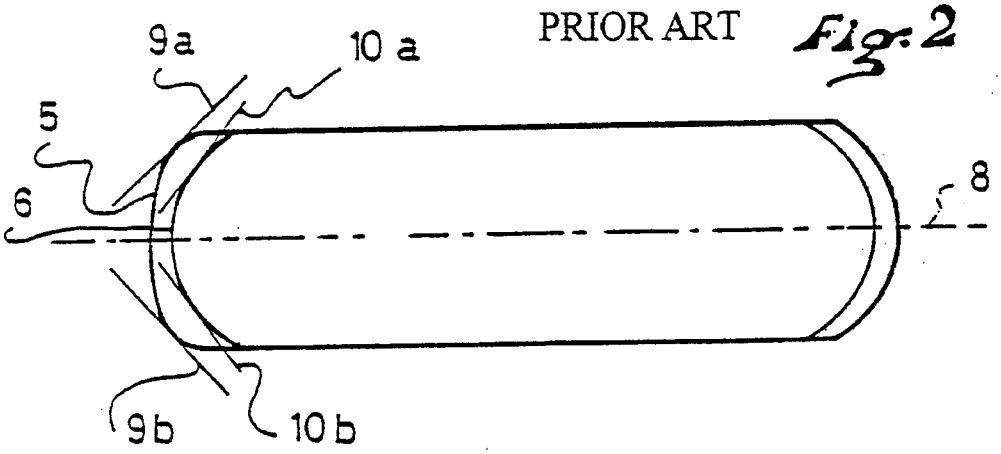
PRIOR ART Fig: 2

FIGS. 1 and 2 illustrate the state of the art and show a boot 1 with a sole 2 such as defined by the ISO 5355 Standard.

Sole 2 has in particular a front end or tip 3 and rear tip 4.

The front tip 3 which is more particularly the subject of the invention comprises a lower sole portion defined by a sole surface 5 and an upper vamp portion defined by an upper surface 6 positioned on the vamp of the boot. The form of these two surfaces 5 and 6 is defined by the Standard. In a normal manner, the front tip of the boot is retained in the front binding element either by its sole portion, or by its vamp portion, i.e., the jaw of the binding element is in contact either with the sole surface 5, or with vamp surface 6. In the first case, one says normally that the binding element grips the vamp of the boot, and in the second case, it grips the sole.

FIG. 2 shows the contour of the front tip, seen from above.

According to the standard presently utilized, surfaces 5 and 6 are symmetrical with respect to the vertical median plane whose outline is schematically shown at 8 in FIG. 2. Surface 5, seen from above, has in its central portion the form of an arc of a circle of large radius, which is laterally bordered on each side by an arc of a circle of smaller radius. The surface of vamp 6, seen from above has the form of an arc of a circle of large radius. Fine lines 9*a* and 9*b* schematically show tangents to the surface of sole 5, and fine lines 10*a* and 10*b* show tangents to the surface of the vamp. These tangents approximately localize the zones where the jaw retains the tip of the boot along a lateral direction, when the boot is in the centered position on the ski.

In a known manner, the jaw of the binding element retains the boot by a localized contact in these zones, either by a grip on the vamp, or by a grip on the sole. A lateral bias exerted by the boot on the jaw beyond the ejection threshold of the binding element drives the jaw and causes the lateral movement of the jaw. In the course of this movement, generally, the tip of the boot slides along a lateral edge of the jaw, until escaping completely therefrom. The boot is thus ejected. It must be noted that during this ejection movement, the boot is in contact with the jaw only in the normalized zone of the front tip, and more precisely only in a right or left portion of the vamp or of the sole.

Figure 3:
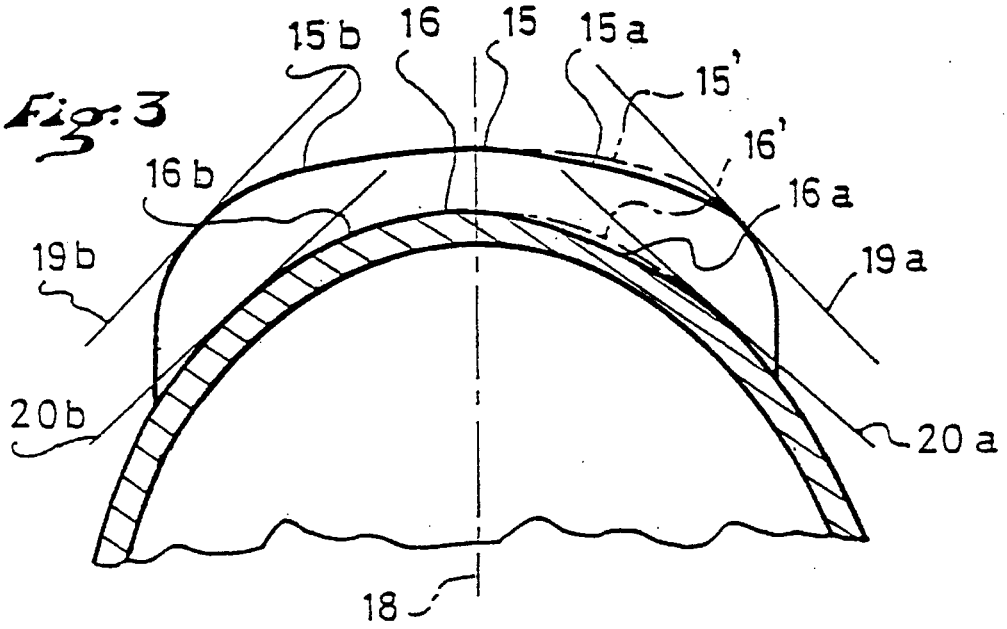
FIG. 3 is a top view and in partial cross section of the front of a boot according to a first embodiment of the invention.

FIG. 3 shows a top view of the front tip of a boot according to a first embodiment of the invention.

There is shown in FIG. 3 the surface 15 of the sole, and the vamp surface 16 of the tip. There is likewise shown at 18 the median plane outline, and at 19*a*, 19*b*, 20*a*, 20*b*, the tangents to the sole surface and the vamp surface, which approximately define the contact zones between the tip and its binding element.

According to this embodiment of the invention, the surfaces of the vamp and/or the sole are rendered asymmetrical with respect to the median plane 18.

FIG. 3 shows on the left side of the median plane 18, surface portions 15*b* and 16*b* of traditional shape. On the right side, the dashed lines 15' and 16' show the symmetrical image of portions 15*b* and 16*b* with respect to median plane 18.

As may be seen in FIG. 3, surfaces 15 and 16 have a right portion 15*a* and 16*a*, which is substantially retracted with respect to the corresponding symmetrical portion 15' and 16'.

Preferably, surfaces 15*a* and 16*a* are retracted between the tangent zones with the planes 19*a* and 20*a* and the median plane so as not to modify the conditions in which the boot is retained in the centered positioned by a binding element. Furthermore, this general curvature of surfaces 15 or 16 has no marked discontinuity in this retracted zone.

For example, as is shown in FIG. 3, the right portion of the surface of the vamp or of the sole progressively distances itself from the symmetrical portion then progressively approaches, between the contact zone with the tangents 19*a* and 20*a* and the outline of the median plane.

Significant results have been obtained with a standard boot of which one portion on surface 15*a* and 16*a* has been thinned down to a thickness varying progressively from 0 to 1.5 millimeters. Naturally, this is not limiting for the invention, and the asymmetry could be more or less pronounced.

The boot of FIG. 3 acts in the following manner. In the centered position, the boot is retained in a front binding element in the same manner as a traditional boot.

For the boot of FIG. 3, if the boot biases the binding element through its left portion, beyond the release threshold of the binding element, the ejection of the boot will occur in the same manner as in the case of a traditional boot.

On the other hand, if the boot biases the binding element through its right portion, it could escape more easily the jaw of the binding, by virtue of its contact surface with the binding element which is retracted with respect to a traditional boot. The ejection of the boot is thus facilitated on one side relative to the other.

Preferably, as is shown in FIG. 3, the retraction is present both on the surface of the vamp and on the surface of the sole, in a manner such that an easier ejection is obtained both with the standard binding elements which grip the upper as well as those which grip the sole. It is self-evident that the retraction can be present only on the surface of the vamp, or only on the surface of the sole.

Furthermore, it is self-evident that, preferably, the other boot has one or more retractions of the same type, but on the other side of the boot. In this way, the two knees of the skier are protected in an improved manner by an ejection of the boot which is easier on the side where the knee is more fragile. It is appropriate to note that this result is achieved without requiring a pairing up of the skis with the boots, i.e., the skier need not pay attention to whether a ski is right or left, he can put on each ski as desired from the right side or the left side.

FIG. 4 relates to another embodiment of the invention. According to this way of performing the invention, the surfaces of sole 25 and vamp 26 have the traditional shape. However, on one of the sides 25*a*, 26*a*, it has been sought to improve the gliding conditions of the tip, i.e., diminish the friction between the tip and the jaw.

Thus, according to FIG. 4, the tip has on the right side of the median plane 28 a recess 21 at the level of the sole, and 22 at level of the tip. The recesses 21 and 22 extend along the height of the standardized zone, substantially along the length of the portion of the surface of the vamp and of the sole positioned on one side of the median plane and they are filled by a plate of low friction material 23, 24, for example, a layer of polytetrafluoroethylene. This layer has a thickness equal to the depth of the recess, and it is assembled to the rest of the shell of the boot by any appropriate means, and for example, by gluing.

If the boot is borne on the jaw of the binding element by one of zones 25*a*, 26*a* of improved friction, it will be more easily freed than if it is carried at one of the other zones 25*b*, 26*b*.

As in the preceding case, one could have a single anti-friction plate positioned on the surface of the vamp or on the surface of the sole.

Alternatively, FIG. 5 shows the recesses of the vamp and of the sole occupied by a series of vertical rollers or needles shown schematically at 29.

According to another embodiment shown in FIG. 6, the low friction tip portion is the external surface 35*a*, 36*a* of an attached element 33 formed out of the material having a lower friction than the rest of the tip. In a usual manner, a ski boot shell is formed out of polyurethane or polypropylene. In this case, the attached element can be formed out of this type of material but with the addition of graphite, polytetrafluoroethylene or silicone oil fillers.

Other solutions are also possible, for example a two-material attached element, having a surface of low friction material imbedded in a support material having good mechanical characteristics. Another possibility comprises molding the shell of the boot or the tip out of a single piece, and before the injection, depositing on the bottom of the mold, on one side of the tip, a small layer made out of low friction material on which the material of the shell or of the tip would be injected.

Furthermore, for the embodiments of FIGS. 4 and 6, instead of seeking to diminish the friction between the jaw and the boot on one side of the boot, one can likewise seek to increase this friction on the other side of the boot.

Naturally, the different embodiments which have since been described can be combined.

Furthermore, the instant application is based upon French Patent Application No. 94.08941, filed Jul. 13, 1994, the priority of which is hereby claimed under 35 U.S.C. §119, and the disclosure of which is hereby incorporated by reference thereto.

Although the invention has been described with reference to particular means, materials and embodiments, it is to be understood that the invention is not limited to the particulars disclosed and extends to all equivalents within the scope of the claims.

What is claimed is:

1. A ski boot adapted to be retained in support upon a ski and to be released from a front binding element and a rear binding element affixed to the ski, said ski boot comprising:

a front tip adapted to be engaged with the front binding element, said front tip extending on each side of a median vertical plane of said ski boot; and said front tip having means for retaining said ski boot in support upon the ski by engagement with said front binding element with asymmetrical mechanical characteristics with respect to said median vertical plane of said ski boot for facilitating release of said ski boot resulting from a torsional bias of said ski boot beyond a bias threshold, said bias threshold being different in a first direction of torsional bias compared to a second direction of the torsional bias.

2. A ski boot according to claim 1, wherein:

said means for retaining said ski boot in support upon the ski comprises a retention zone having an asymmetrical shape with respect to said median vertical plane of said ski boot for facilitating release of said ski boot more easily for rotation to one side of said median vertical plane than to another side of said median vertical plane.

3. A ski boot according to claim 2, wherein:

said means for retaining said ski boot in support upon the ski comprises a sole surface and a vamp surface;

at least one of said sole surface and said vamp surface comprises a retracted surface on one side of said vertical median plane compared to a symmetrical projection on the other side of said vertical median plane.

4. A ski boot according to claim 3, wherein:

said means for retaining said ski boot in support upon the ski comprises a contact zone of the ski boot adapted to be engaged with a jaw of the front binding element in a centered retained position of said ski boot upon the ski, said retracted surface extending between said contact zone and said vertical median plane.

5. A ski boot according to claim 1, wherein:

said means for retaining said ski boot in support upon the ski comprises a surface on one side of said vertical median plane having a coefficient of friction different from a coefficient of friction of a surface on the other side of said vertical median plane.

6. A ski boot according to claim 3, wherein:

said means for retaining said ski boot in support upon the ski comprises a sole surface and a vamp surface; and at least one of said sole surface and said vamp surface comprises an exterior surface of an anti-friction material embedded in a recess of said front tip of said ski boot.

7. A ski boot according to claim 3, wherein:

said means for retaining said ski boot in support upon the ski comprises an element attached to said front tip of said ski boot, said attached element having a coefficient of friction less than a coefficient of friction of a remaining portion of said front tip of said ski boot.

8. A pair of ski boots adapted to be retained in support upon a respective ski of a pair of skis and each of said pair of ski boots adapted to be released from a front binding element and a rear binding element affixed to a respective ski, said pair of ski boots comprising:

a right ski boot and a left ski boot;

each of said right ski boot and said left ski boot comprising a respective front tip adapted to be engaged with a front binding element, said respective front tip extending on each side of a median vertical plane of a respective one of said right ski boot and said left ski boot;

each said respective front tip having means for retaining said respective ski boot in support upon the ski by engagement with a front binding element with asymmetrical mechanical characteristics with respect to said median vertical plane of said respective one of said right ski boot and said left ski boot for facilitating release of said respective ski boot resulting from a torsional bias of said respective ski boot beyond a bias threshold, said bias threshold being different in a first direction of torsional bias compared to a second direction of the torsional bias;

said median vertical plane of each of said right ski boot and said left ski boot having an interior side and an exterior side; and said mechanical characteristics of said exterior sides of each said median vertical planes being substantially the same and said mechanical characteristics of said interior sides of each said median vertical plane being substantially the same.

9. A pair of ski boots according to claim 8, wherein:

said means for retaining said respective ski boot in support upon the ski of each said respective front tip comprises means for facilitating release of said respective ski boot more easily toward said interior side of each said respective ski boot.

10. A ski boot adapted to be retained in support upon a ski and to be released from a front binding element and a rear binding element affixed to the ski, said ski boot comprising:

a front end comprising a sole portion, comprising a sole surface, and an upper portion, comprising an upper surface, at least one of said sole surface and said upper surface is a retaining surface configured and arranged on said ski boot for engagement with a jaw of the front binding element for retention of said ski boot by the jaw, for driving the jaw during a lateral displacement of said ski boot, and for sliding along the jaw during a lateral displacement of said ski boot for facilitating release of said ski boot from the front binding element; and said at least one of said sole surface and said upper surface has asymmetrical mechanical characteristics with respect to a longitudinal median vertical plane of said ski boot for enabling release of said ski boot resulting from a torsional bias of said ski boot beyond a bias threshold, said bias threshold being different in a first direction of torsional bias compared to a second direction of the torsional bias.

11. A ski boot according to claim 10, wherein:

both of said sole surface and said upper surface have asymmetrical mechanical characteristics with respect to the median vertical plane of said ski boot.

12. A ski boot according to claim 10, wherein:

said asymmetrical mechanical characteristics comprise an asymmetrical shape with respect to the median vertical plane of said ski boot.

13. A ski boot according to claim 10, wherein:

said asymmetrical mechanical characteristics comprise an asymmetrical coefficient of friction of at least one of said sole surface and said upper surface with respect to the median vertical plane of said ski boot.

14. A ski boot according to claim 13, wherein:

said sole surface and said upper surface have a symmetrical shape with respect to the median vertical plane of said ski boot.

15. A ski boot according to claim 10, wherein:

said ski boot comprises an interior side on a first side of the vertical median plane and an exterior side on a second side of the vertical median plane; and said asymmetrical mechanical characteristics of said at least one of said sole surface and said upper surface comprises means for enabling release of said ski boot from the front binding with a lateral bias toward said interior side less than a lateral bias required for release of said ski boot toward said exterior side.

16. A ski boot adapted to be retained in support upon a ski and to be released from a front binding element and a rear binding element affixed to the ski, said ski boot comprising:

a front end extending on each side of a longitudinal median vertical plane of said ski boot, said front end comprising a sole portion having a sole surface and an upper portion having an upper surface, at least one of said sole surface and said upper surface comprises: means for retaining said front end of said ski boot engaged with a jaw of the front ski binding; means for driving the jaw during a lateral displacement of said ski boot; and means for sliding along the jaw during a lateral displacement of said ski boot for facilitating release of said ski boot from the front binding element; and said at least one of said sole surface and said upper surface has asymmetrical mechanical characteristics with respect to the median vertical plane of said ski boot for enabling release of said ski boot resulting from a torsional bias of said ski boot beyond a bias threshold, said bias threshold being different in a first direction of torsional bias toward a first side of the vertical median plane compared to a second direction of the torsional bias toward a second side of the vertical median plane.

17. A ski boot according to claim 16, wherein:

both of said sole surface and said upper surface have asymmetrical mechanical characteristics with respect to the median vertical plane of said ski boot.

18. A ski boot according to claim 16, wherein:

said asymmetrical mechanical characteristics comprise an asymmetrical shape with respect to the median vertical plane of said ski boot.

19. A ski boot according to claim 16, wherein:

said asymmetrical mechanical characteristics comprise an asymmetrical coefficient of friction of at least one of said sole surface and said upper surface with respect to the median vertical plane of said ski boot.

20. A ski boot according to claim 19, wherein:

said sole surface and said upper surface have a symmetrical shape with respect to the median vertical plane of said ski boot.

21. A ski boot according to claim 16, wherein:

said ski boot comprises an interior side on a first side of the vertical median plane and an exterior side on a second side of the vertical median plane; and said asymmetrical mechanical characteristics of said at least one of said sole surface and said upper surface comprises means for enabling release of said ski boot from the front binding with a lateral bias toward said interior side less than a lateral bias required for release of said ski boot toward said exterior side.

* * * * *